US006904677B2

(12) United States Patent
Yamauchi

(10) Patent No.: US 6,904,677 B2
(45) Date of Patent: Jun. 14, 2005

(54) METHOD OF MANUFACTURING TUBE AND APPARATUS FOR MANUFACTURING THE SAME

(75) Inventor: Takumi Yamauchi, Nukata-gun (JP)

(73) Assignee: Denso Corporation, Kariya (JP)

( * ) Notice: Subject to any disclaimer, the term of this patent is extended or adjusted under 35 U.S.C. 154(b) by 106 days.

(21) Appl. No.: 10/412,597

(22) Filed: Apr. 10, 2003

(65) Prior Publication Data

US 2004/0200070 A1 Oct. 14, 2004

(51) Int. Cl.[7] ..... B21D 21/00
(52) U.S. Cl. ..... 29/890.053
(58) Field of Search ..... 29/890.053, 890.057, 29/890.052, 426.4, 426.1, 426.6, 430, 429, 432.1, 438, 439, 455.1, 411, 412, 414, 417; 165/177

(56) References Cited

U.S. PATENT DOCUMENTS 5,209,800 A * 5/1993 Spencer et al. ..... 156/158

FOREIGN PATENT DOCUMENTS

| | | |
|---|---|---|
| JP | 63-049303 | 3/1988 |
| JP | 6-159986 | 6/1994 |
| WO | WO/95/05571 | 2/1995 |

* cited by examiner

*Primary Examiner*—John C. Hong
(74) *Attorney, Agent, or Firm*—Harness, Dickey & Pierce, PLC

(57) ABSTRACT

In a method of manufacturing a tube that has a plurality of projections (dimples) protruding inwardly from an inside wall of the tube other than a longitudinal end, a work, which is a material of the tube and in a form of band plate, is shaped by a roller to form projections while the work is continuously fed. Then, the projections formed at a predetermined portion of the work are crushed so that the predetermined portion of the work is flattened. Therefore, the projections are formed continuously while the work is continuously fed. It is possible to deal with variations of length of the tube without exchanging a projection-forming roller, thereby improving productivity.

20 Claims, 10 Drawing Sheets

METHOD OF MANUFACTURING TUBE AND APPARATUS FOR MANUFACTURING THE SAME

CROSS REFERENCE TO RELATED APPLICATION

This application is based on Japanese Patent Application No. 2001-254498 filed on Aug. 24, 2001, the disclosure of which is incorporated herein by reference.

FIELD OF THE INVENTION

The present invention relates to a method of manufacturing a tube used for a heat exchanger such as a radiator and a water heater and an apparatus for manufacturing the tube.

BACKGROUND OF THE INVENTION

According to a radiator for a vehicle disclosed in JP-A-6-159986, dents or projections (dimples) are formed on inside walls of tubes at least at portions other than longitudinal ends (header insertion portions) of the tubes. This improves a coefficient of heat transfer between fluid flowing through the tubes (e.g. cooling water and hot water) and the tubes. Further, this restricts gaps between the header insertion portions of the tube ends and insertion holes formed on header tanks from excessively increasing, thereby preventing defective brazing between the tubes and the header tanks.

With respect to a method of manufacturing the tube, a work in a form of band plate is pressed so that dimples are formed. Further, to deal with variation of length of the tubes, it is proposed to control the timing of feeding the work into a pressing device and the timing of operation of the pressing device so that portions where the dimples are formed can be changed. After the dimples are formed, the work is shaped into a tube by a shaping roller and thereafter cut into a predetermined length. In this method, however, the work is fed intermittently. Therefore, it is difficult to continuously form the dimples, resulting in low productivity and production rate.

On the other hand, it is proposed to use a roller shaping machine having a roller formed with dents or projections on its outer peripheral surfaces in order to continuously form dimples. The roller has a portion having the dents or projections for forming the dimples and a portion without having the dents or projections. By this, portions where the dimples are formed and portions where the dimples are not formed, which corresponds the header insertion portions, are formed at predetermined intervals. In this method, however, the roller needs to be exchanged with another roller whenever the length of the tubes is changed. Therefore, it is difficult to deal speedily with variations in the length of the tubes.

SUMMARY OF THE INVENTION

The present invention is made in view of the forgoing matters and it is an object of the present invention to provide a method of manufacturing tubes, which have a plurality of projections (dimples) projecting inwardly at portions other than predetermined portions, capable of dealing speedily with variations of length of the tubes and improving productivity.

It is another object of the present invention to provide an apparatus for manufacturing tubes, which have projections (dimples) projecting inwardly at portions other than predetermined portions, capable of improving productivity by dealing with variations of length of the tubes.

According to the present invention, a method of manufacturing tubes, each of which has a plurality of projections projecting inwardly at a portion other than a predetermined portion. includes pressing a work having a shape of band plate to form projections while the work is fed in its longitudinal direction, crushing a projection formed at a predetermined portion of the work to flatten the predetermined portion, and shaping the work into a tubular shape and cutting the work into predetermined lengths to form the tubes.

According to the method, the projections are formed continuously while the work is continuously fed. To contrast with a method of feeding the work intermittently, the projections can be formed continuously. Therefore, productivity and production rate of the tubes improve. In addition, by changing the portion to be crushed, the portions without having the projections, such as portions corresponding to ends of the tubes, can be changed easily. Therefore, the method can deal with variations of length of the tubes without exchanging a roller. Accordingly, the method of manufacturing the tubes of the present invention deals with tube length variations and improves productivity and production rate.

Alternatively, the method of manufacturing the tubes of the present invention includes a first step of pressing only a predetermined portion of the work to form a projection at the predetermined portion and a second step of shaping the work into a tube and cutting the work into a predetermined length. By this, it is possible to deal speedily with variations of length of the tubes without exchanging the roller. Accordingly, productivity and production rate improve, as compared with a method of feeding the work intermittently.

According to the present invention, an apparatus for manufacturing the tubes includes a first shaping device that forms projections on the work having a shape of band plate by pressing while the work is continuously fed in Its longitudinal direction, a second shaping device that flattens a predetermined portion of the work by crushing a projection formed at the predetermined portion, and a third shaping device that shapes the work into a tubular shape and cuts the work into hail predetermined lengths to form the tubes. The third shaping device is placed forward of the second shaping device In a feed direction of the work.

The apparatus can form the projections continuously while the work is continuously fed. In contrast with the method of feeding the work intermittently, productivity of tubes and production rate improve because the projections can be formed continuously. Further, portions without having the projections, such as portions corresponding to ends of tubes, can be easily changed by changing portions that are crushed by the second shaping device. Therefore, it is possible to deal with variations of length of tubes without exchanging a roller.

Alternatively, the apparatus for manufacturing the tubes of the present invention includes a first shaping device that forms projections at a predetermined portion of the work by pressing only the predetermined portion while the work is continuously fed in its longitudinal direction, and a second shaping device that shapes the work into a tube and cutting the work into a predetermined length. The second shaping device is placed forward of the first shaping device in the feed direction of the work. By this, it is not required to exchange a roller. Accordingly, productivity of the tubes and production rate improve.

DETAILED DESCRIPTION OF EMBODIMENTS

Embodiments of the present invention will be described hereinafter with reference to the drawings.

[First Embodiment]

Figure 1:
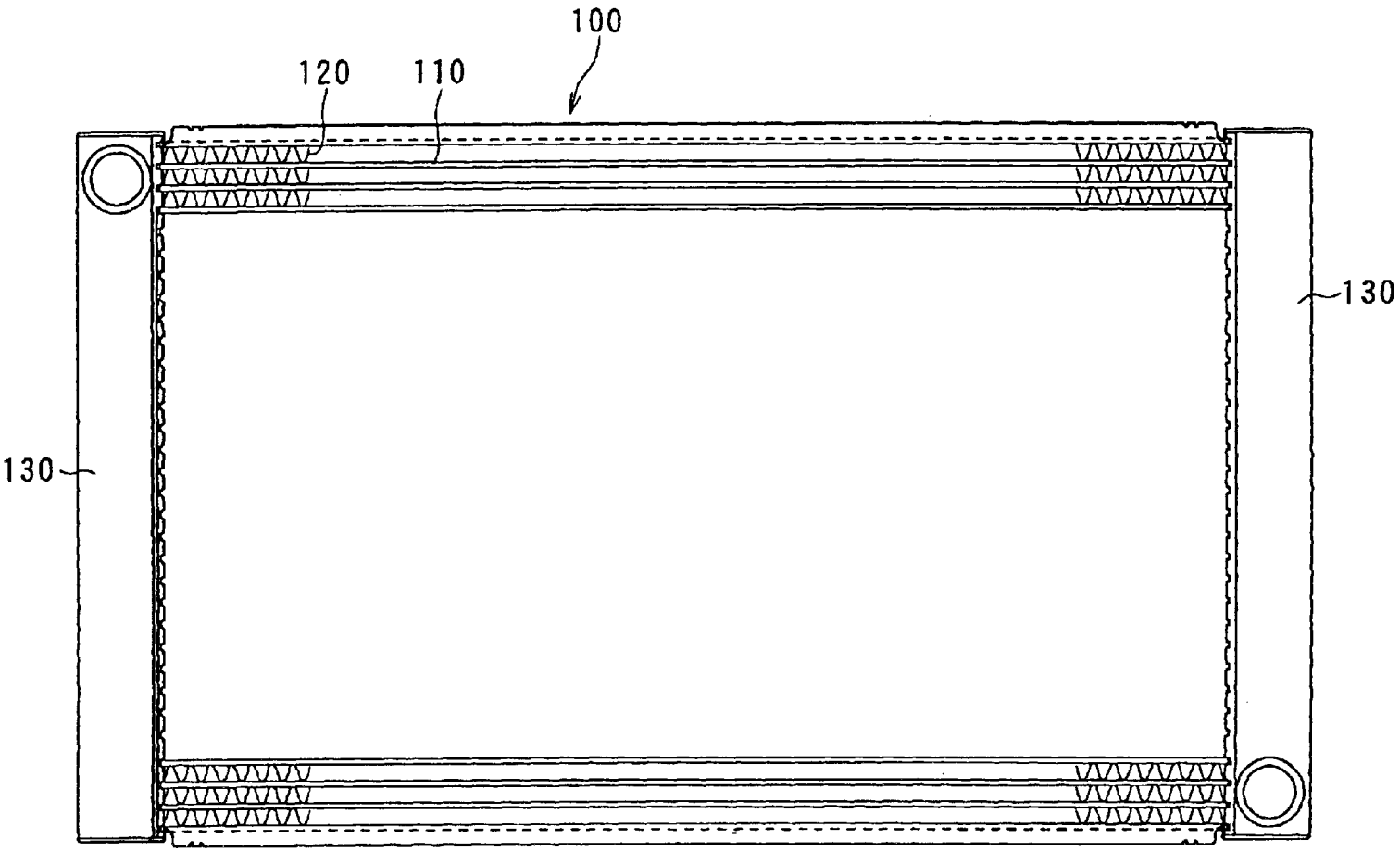
FIG. 1 is a plan view of a radiator according to the first embodiment of the present invention.

Tubes of the present invention are for example used for a radiator that is a kind of a heat exchanger performing heat exchange between a vehicular engine coolant and air. FIG. 1 is a plan view of the radiator according to the embodiment.

Referring to FIG. 1, radiator tubes (hereinafter, tubes) 110 are made of aluminum. The engine coolant (fluid) flows through the insides of the tubes 110. Radiator fins (hereinafter, fins) 120 are made of aluminum. The fins 120 are attached to the outside surfaces of the tubes 110 to increase heat-radiating areas. The tubes 110 and the fins 120 construct a heat-exchanging core portion for performing heat exchange between the engine coolant and the air. The tubes 110 will be described later in detail.

Header tanks (hereinafter, tanks) 130 are made of aluminum. The tanks 130 are located at the longitudinal ends of the tubes 110 to communicate with the tubes 110. One of the tank 130 (for example, left tank in FIG. 1) is to distributes the engine coolant into the tubes 110 and the remaining tank 130 (right tank) is to collect the engine coolant that has been exchanged heat between itself and air. The tubes 110, the fins 120 and the tanks 130 are brazed together by a brazing material. The brazing material contains a metal having a melting point lower than that of the aluminum forming the tubes 110, the fins 120 and the tanks 130.

Next, the tubes (tube bodies) 110 will be described.

Figure 2:
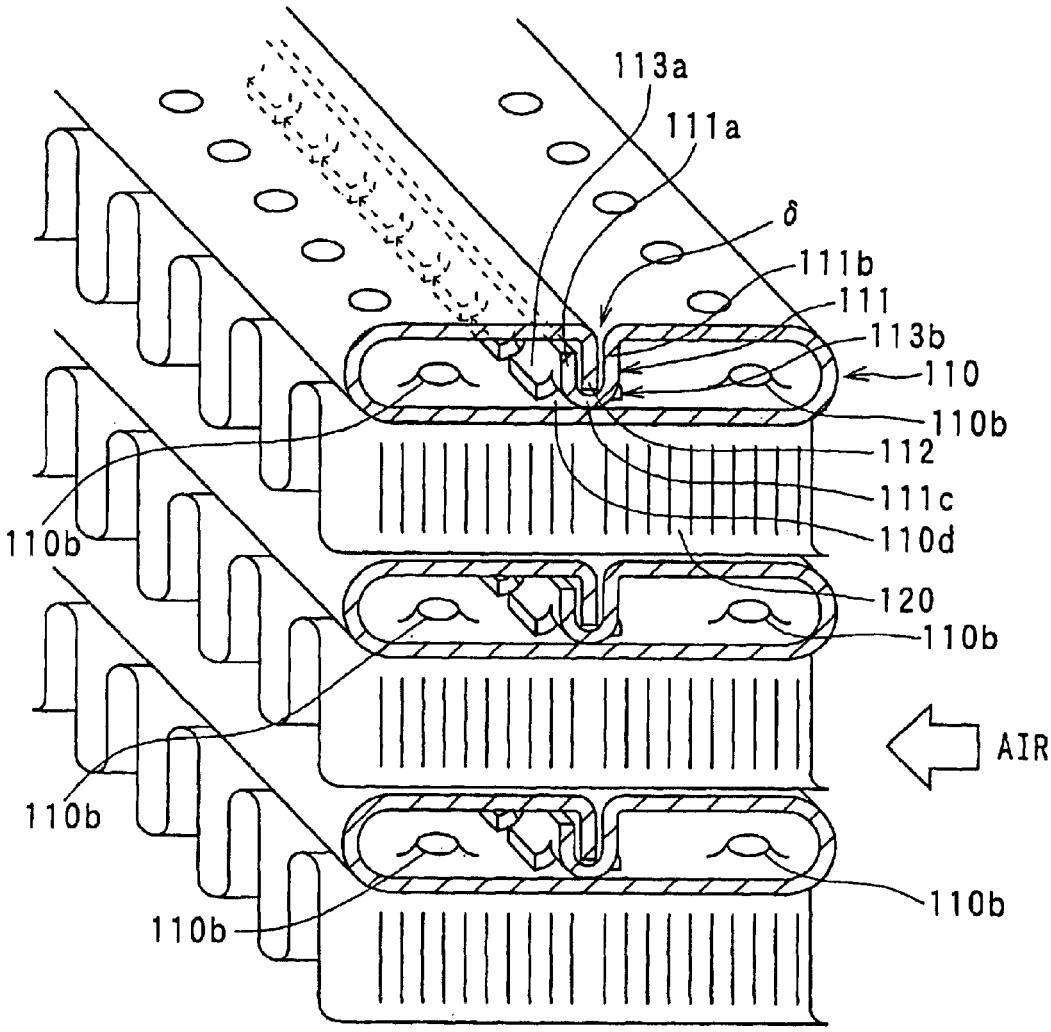
FIG. 2 is an enlarged perspective view of a core portion of the radiator according to the first embodiment of the present invention.
Figure 3:
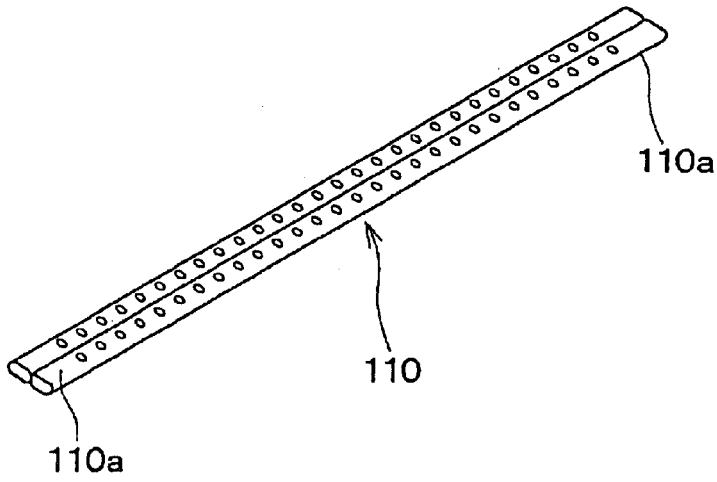
FIG. 3 is a perspective view of a tube according to the first embodiment of the present invention.

FIG. 2 is a perspective view of the heat-exchanging core portion and partly includes a cross-section. The tube 110 is produced by shaping an aluminum band plate into a flat tube. The tubes 110 are arranged such that a flow direction of air passing between the tubes 110 is substantially parallel to a major axis of a tube cross-section. Also, a passage (inside space) through which the engine coolant flows of the tube 110 is divided into two spaces in substantially a middle portion with respect to the major axis direction of the tube cross-section. As shown in FIG. 3, the tubes 110 are formed with a plurality of projections (dimples) 110*b* projecting inside of the tubes 110. The projections are formed over the tubes 110 other than the longitudinal ends (insertion portions) 110*a* that are inserted into the tanks 130.

As shown in FIG. 2, in the tube 110, a groove portion (wrapping groove) 111 is formed at a side of a work (a plate material) having a shape of band plate by bending the side, and an insert portion (wrapped end portion) 112 is formed at a remaining side of the work. The groove portion 111 and the insert portion 112 are brazed in a condition that the insert portion 112 is interposed in the groove portion 111. The groove portion 111 includes a first side wall (wrapping end portion) 111*a*, a second side wall (wrapping base portion) 111*b* opposing to the first side wall 111*a*, and an arc-shaped connecting portion 111*c* connecting the first side wall 111*a* and the second side wall 111*b*. The groove portion 111 has substantially a U-shaped cross-section. The groove portion 111 is located in the inside of the tube 110.

The second side wall 111*b* is integrally formed and connected from the inside wall of the tube body 110. On the other hand, the first side wall 111*a* is not integrally connected from the inside wall of the tube wall 110 before the brazing because it is formed at the side of the plate member. After the brazing, the first side wall 111*a* is integrated with the inside wall of the tube body 110 by the brazing material.

The first side wall 111*a* is formed with first projections (contact claws) 113*a*. The first projections 113*a* project from a portion between the first side wall 111*a* and the connecting portion 111*c* to a side opposite to the connecting portion 111*c* with respect to the first side wall 111*a* (toward left bottom in FIG. 2). Similar to this, the second side wall 111*b* is formed with second projections (receiving claws) 113*b*. The second projections 113*b* project from a portion between the second side wall 111*b* and the connecting portion 111*c* to a side opposite to the connecting portion 111*c* with respect to the second side wall 111*b* (to right bottom in FIG. 2). The ends of the first projections 113*a* and the second projections 113*b* are in contact with the inside wall 110*d* opposing to the connecting portion 111*c* (the inside wall 110*d* is an inside wall located under the connecting portion 111*c* in FIG. 2). The connecting portion 111*c* is also in contact with the inside wall 110*d*.

Next, the method of manufacturing the tubes 110 and the radiator will be described.

Figure 4:
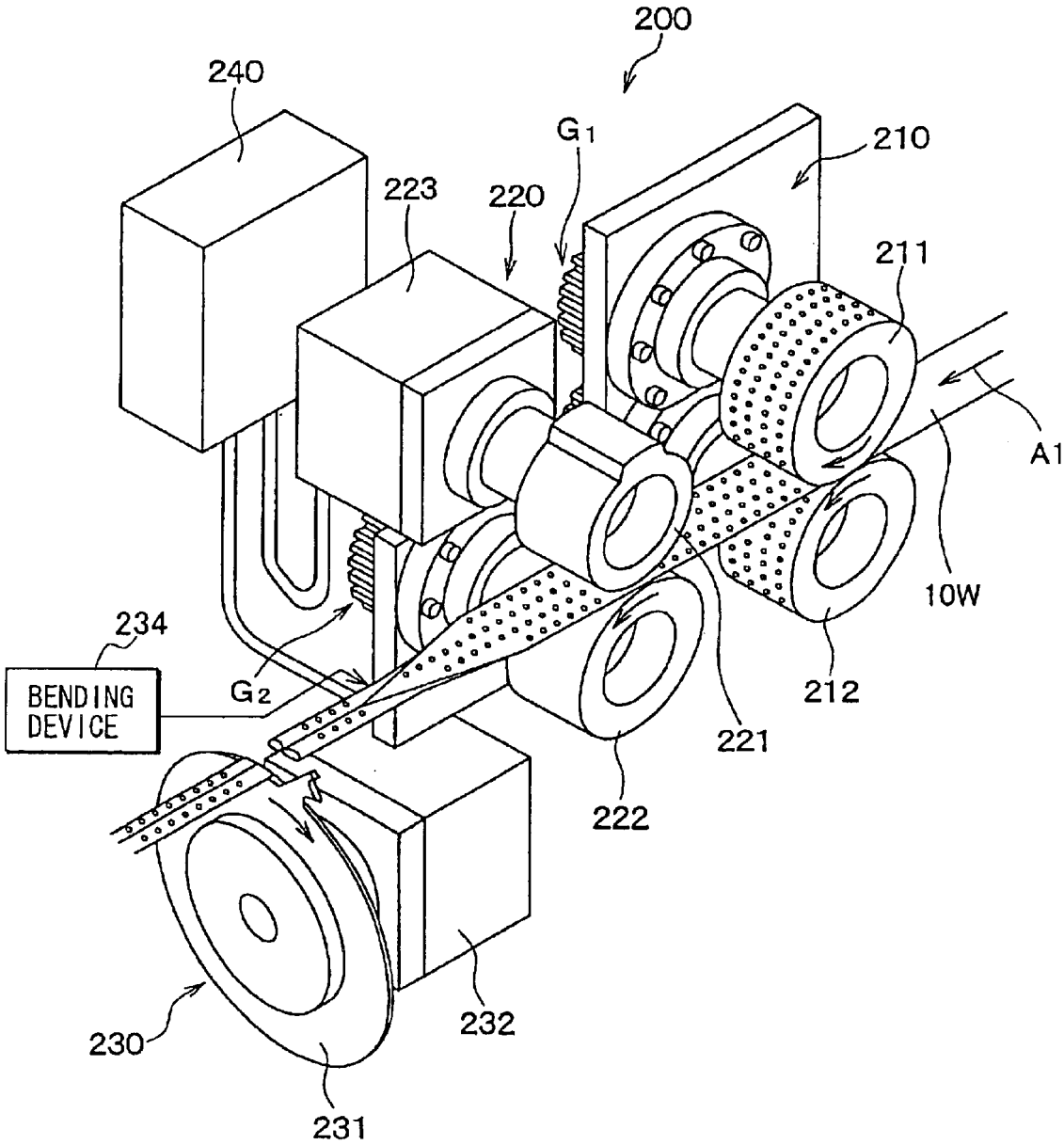
FIG. 4 is a perspective view of an apparatus for manufacturing the tube according to the first embodiment of the present invention.
Figure 5A:
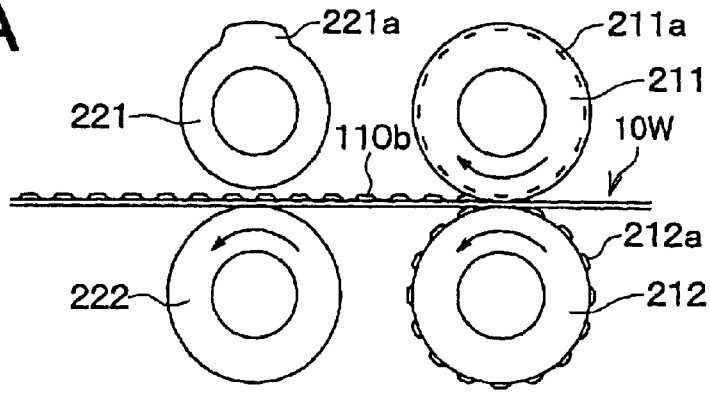
FIGS. 5A to 5D are explanatory views for illustrating operations of the apparatus for manufacturing the tube according to the first embodiment of the present invention.
Figure 5B:
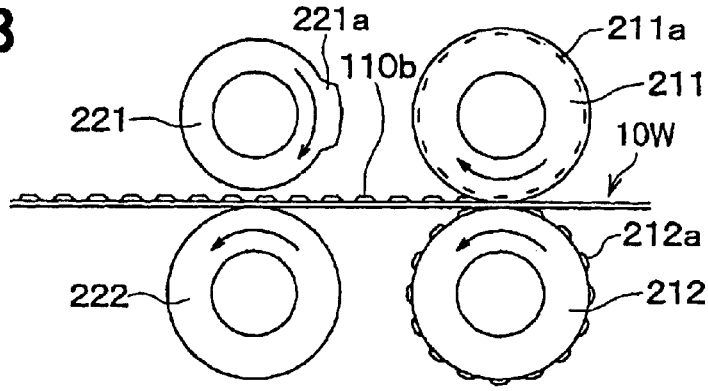
Figure 5C:
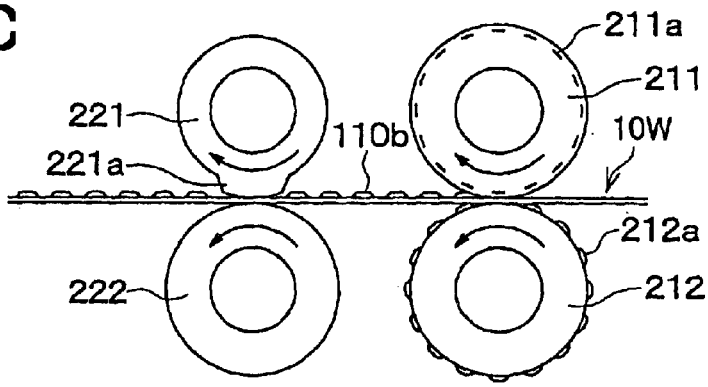
Figure 5D:
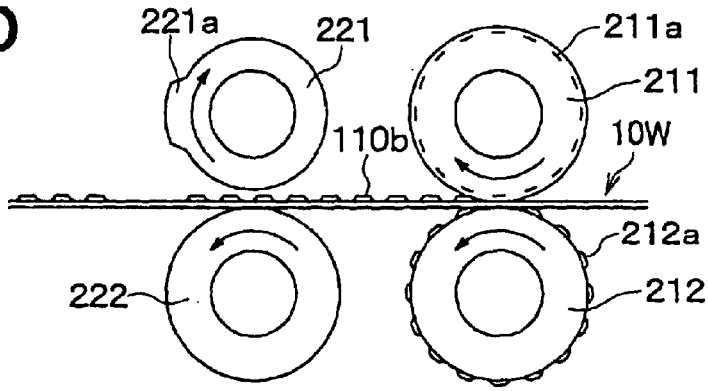
Figure 6A:
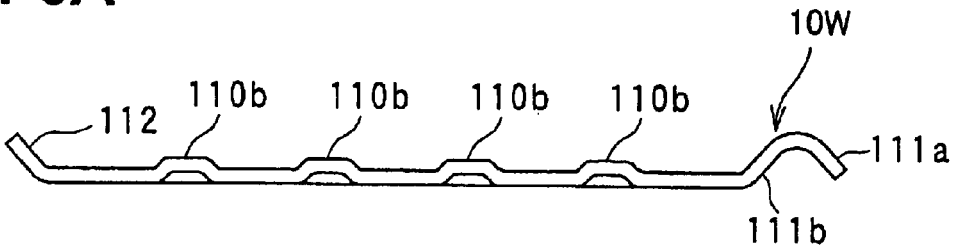
FIGS. 6A to 6D are explanatory views for illustrating a process of bending the tube according to the first embodiment of the present invention.
Figure 6B:
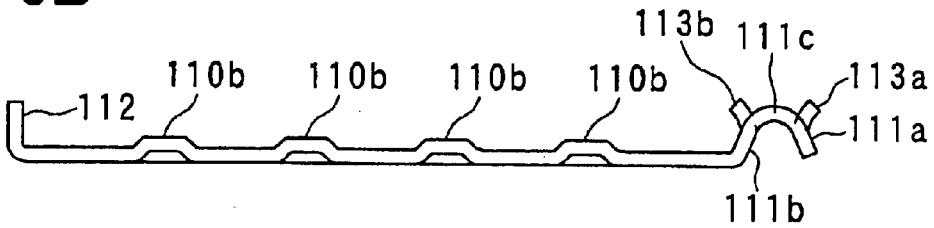
Figure 6C:
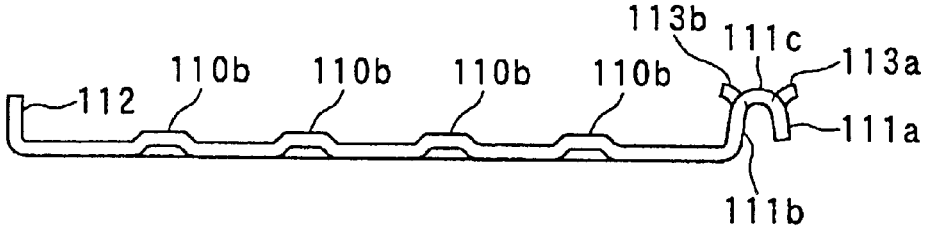
Figure 6D:
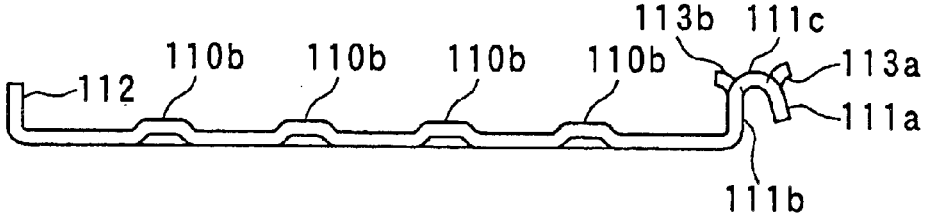

FIG. 4 is a schematic view of a tube manufacturing apparatus 200 employing the method of manufacturing the tubes of the embodiment. Numeral 10W denotes the work, which is a material of the tubes 110, in a form of band plate. A base material of the work 10W is aluminum and at least one of surfaces of the work 10W is coated (clad) with a brazing material. The work 10W is fed continuously at a predetermined speed in a direction denoted by an arrow A1 of FIG. 4 by a pair of cylindrical (tubular) rollers of a feeding device (not shown).

A projection-forming device (first shaping device) 210 is a roller shaping device that shapes the work 10W while rotating. That is, the work 10W is pressed while continuously fed in its longitudinal direction (A1) so that the projections 110*b* are formed. The projection-forming device 210 includes a pair of projection-forming rollers 211, 212 that are arranged to sandwich the work 10W from both the surfaces.

As shown in FIGS. 5A to 5D, the projection-forming roller 212 that is placed under the work 10W in FIGS. 5A to 5D is formed with projections 212*a* for pressing and developing the work 10W partly. On the other hand, the projection-forming roller 211 that is placed above the work 10W is formed with dents 211*a* corresponding to the projections 212*a*.

A projection-crushing device (second shaping device) 220 shown in FIG. 4 is a roller shaping device that shapes the work 10W while rotating. The projection-crushing device 220 crushes the projections 110*b* that are formed at predetermined portions in the work low (portions corresponding to the tank insertion portions 110*a*) so that the predetermined portion of the work 10W is flattened. As shown in FIGS. 5A to 5D, the projection-crushing device 220 includes a pair of projection-crushing rollers 221, 222 that are arranged to sandwich the work 10W from both the surfaces of the work 10W. The projection-crushing roller 222 that is placed under the work 10W in FIGS. 5A to 5D has a simple cylindrical (tubular) shape. The projection-crushing roller 222 rotates with the projection-forming rollers 211, 212 at the same speed. Here, as shown in FIG. 4, the projection-crushing roller 222 is mechanically linked with the projection-forming rollers 211, 212 through gears G1, G2.

The projection-crushing roller 221 that is placed above the work 10W is formed with a pressing projection 221*a* for crushing the projections 110*b*. The pressing projection 221*a* is formed only at a predetermined area in the cylindrical surface of the projection-crushing roller 221. The projection-crushing roller 221 is electrically connected with a cutting device 230 (described later). The projection-crushing roller 221 rotates at a rate in accordance with length of the tubes 110 to be manufactured and crushes the projections formed at the predetermined portion by the pressing projection 221*a*.

Therefore, the projection-forming device 210 (projection-forming rollers 211, 212) and the projection-crushing roller 222 are operated by the same servomotor (driving device). Also, the projection-crushing device 221 is operated by another servomotor 223.

The tube 110 (work 10W) Is shaped Into a flat tube by a bending device (described later) 234 and cut into a predetermined length by the cutting device 230. A cutter 231 of the cutting device 230 is driven by a servomotor (driving device) 232 that Is electrically connected to the servomotor 223 of the projection-crushing roller 221, to rotate with the projection-crushing roller 221.

The projection-crushing device 220 (specially, the projection-crushing roller 221) and the cutting device 230 are controlled by a control unit 240.

As shown by a general box in FIG. 4, the bending device, which functions to bend the band plate work 10W into a flat tube shown in FIG. 2, is provided between the projection-crushing device 220 and the cutting device 230. FIGS. 6A to 6D and 7A to 7D illustrate the works l0W in time sequence while the work 10W Is bent by the bending device 234.

In the order from FIG. 6A to FIG. 6D, sides of the work 10W is bent to form the groove portion 111 and the insertion portion 112. (Side forming step) The work 10W is further bend in the order shown from FIGS. 7A to 7D. Thus, the insertion portion 112 is interposed in the groove portion 111.

(Inserting Step)

Next, operation of the tube manufacturing apparatus 200 and the method of manufacturing the tube of the embodiment will be described.

First, the projection-forming device 210 presses the work low while the work low continuously feeds in the longitudinal direction (A1), thereby forming the projections 110*b*. (First step) Next, the projection-crushing device 220 crushes the projections 110*b* formed at the predetermined portion, such as at the portion corresponding to the tank insertion portion 110*a*, thereby flattening the predetermined portion of the work 10W.

(Second Step)

Thereafter, the work 10W is shaped into a flat tube by the bending device 234 provided forward of the projection-crushing device 220 in the feed direction (A1) of the work l0W and cut into the predetermined length by the cutting device 230.

(Third Step)

After the tubes 110 are produced in this way, the tubes 110 and the fins 120 are alternately laminated, so the heat-exchanging core portion is assembled. Then, the tubes 110 and the fins 120 are compressed by using a tool such as a wire so that the tubes 110 and the fins 120 are press-contact to each other. (Temporary assembling step) After, the heat-exchanging core portion is joined with the tanks 130 by integrally brazing.

(Brazing Step)

Figure 7A:
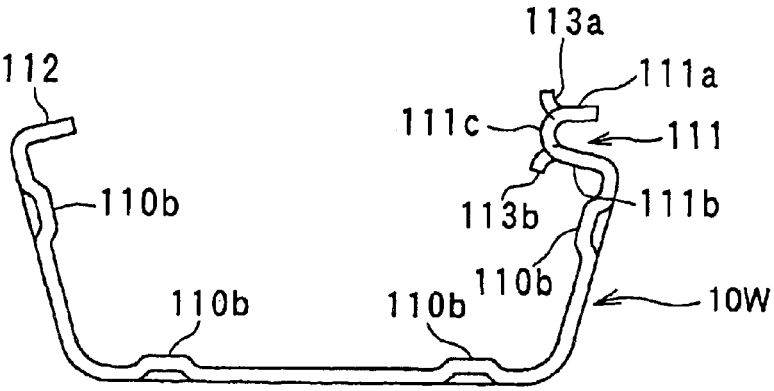
FIGS. 7A to 7D are explanatory views for illustrating the process of further bending the tube according to the first embodiment of the present invention.
Figure 7B:
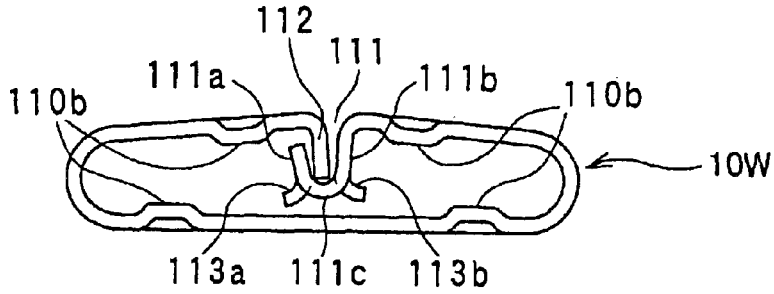
Figure 7C:
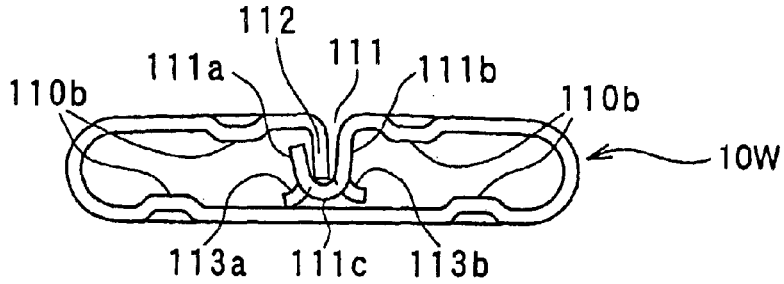
Figure 7D:
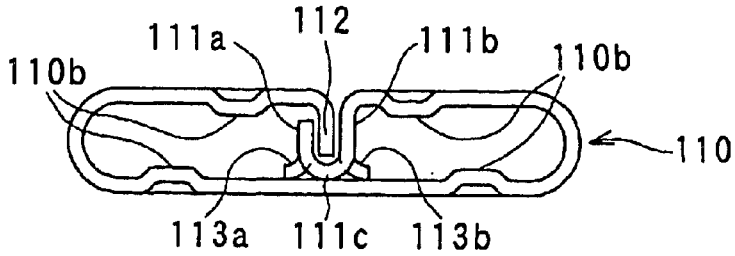
Figure 8A:
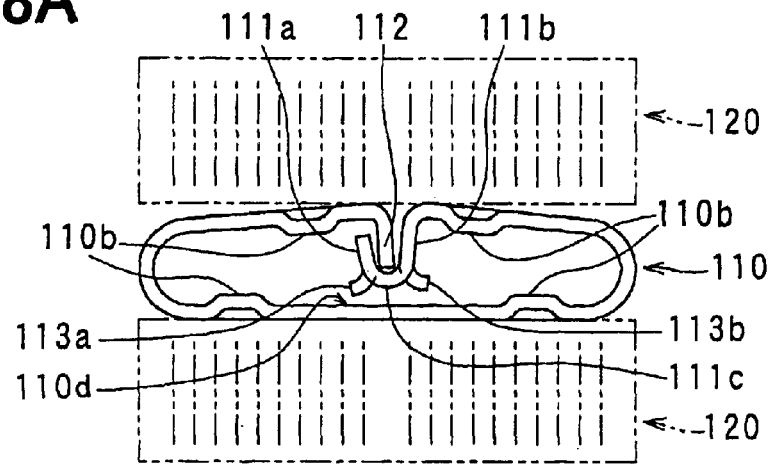
FIGS. 8A to 8C are explanatory views for illustrating a process of manufacturing the core portion shown in FIG. 2.

Here, after the completion of the inserting step, the work 10W changes its shape from a state shown in FIG. 7D to a state shown in FIG. 7B by a spring back force. In the temporary assembling step, the tubes 110 and the fins 120 are compressed in a direction parallel to the first side wall 111*a* and the second side wall 111*b*, that is, parallel to minor axes of the tube cross-sections. Therefore, the tubes 110 are bent in the order shown from FIG. 8A to FIG. 8C during the temporary assembling step. Then, the tubes 110 are brazed in the conditions shown in FIG. 8C. Hereinafter, the force compressing the tubes 110 and the fins 120 is referred to as a compress force of the temporary assembling step.

Next, features of the embodiment will be described.

After the projections 110*b* are formed, the projections 110*b* formed at the predetermined portion of the work 10W is crushed and the predetermined portion of the work 10W is flattened. Therefore, the projections 110*b* are continuously formed while the work 10W is continuously fed. In contrast with a case of feeding the work 10W intermittently, the projections 110*b* are formed continuously. Accordingly, productivity of the tubes 110 improves.

Also, because operation timing of the projection-crushing roller 221 is controlled, portions where the projections 110*b* are crushed can be changed. Therefore, the portions without having the projections 110*b*, for example, the portions corresponding to the tank insertion portions 110*a*, can be changed easily. Accordingly, it is possible to deal with variations of length of the tubes 110 without exchanging the rollers 211, 212.

In this way, the method of manufacturing the tubes and the tube manufacturing apparatus of the embodiment can deal with variations in tube length smoothly and improve productivity and production rate.

Figure 8B:
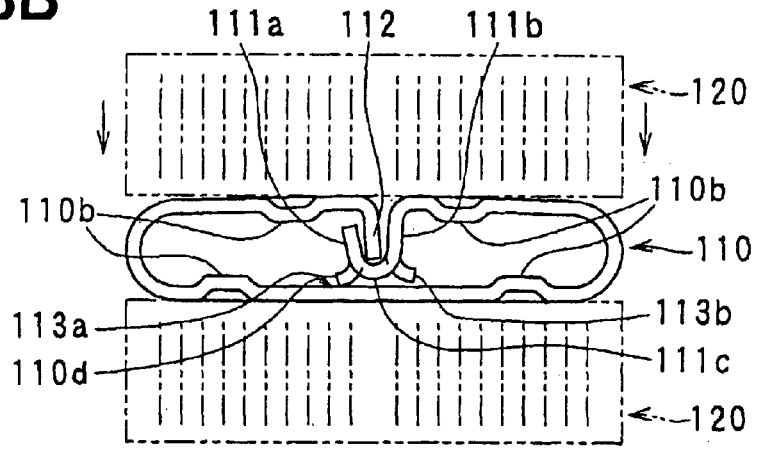
Figure 8C:
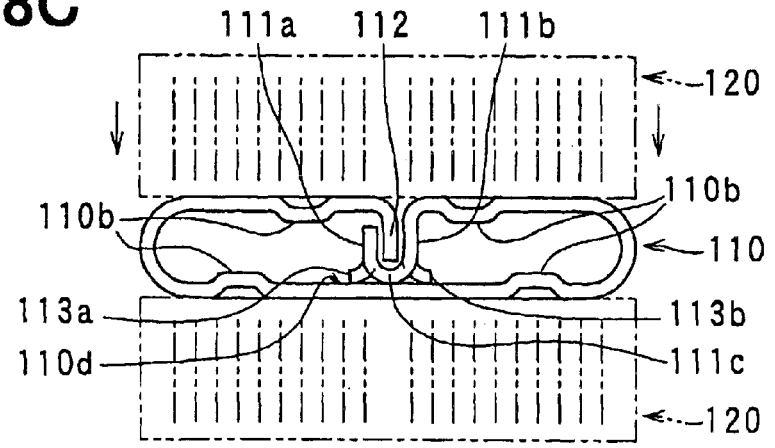

Also, the tube 110 of the embodiment is formed with the first projections 113*a* that project from the portion between the first side wall 111*a* and the connecting portion 111*c* to a side opposite to the connecting portion 111*c* with respect to the first side wall 111*a*. The groove portion 111 easily opens by the spring back force such that a width of the groove, that is, a distance between the first side wall 111*a* and the second side wall 111*b* (see FIG. 8A), increases. When the tubes 110 are compressed, the ends of the first projections 113*a* are brought into contact with the inside wall 110*d* first, as shown in FIG. 8B.

With this, reaction force against the compress force of the temporary assembling step exerts to the ends of the first projections 113*a*. Further, the ends of the first projections 113*a* are in contact with the inside wall 110*d* and fixed thereon. Therefore, a bending moment to reduce the width of the groove is exerted to the first side wall 111*a* and the connecting portion 111*c*. Accordingly, as the compression continues from the state shown in FIG. 8B to the state shown in FIG. 8C, the first side wall 111*a* approaches the insertion portion 112. Further, the first side wall 111*a* comes in contact with the insertion portion 112 and presses the insertion portion 112 toward the second side wall 111*b*.

That is, as the compression increases, the insertion portion 112 is automatically wrapped by the first side wall 111*a* and the second side wall 111*b* that construct the groove portion 111, so the insertion portion 112 is interposed in the groove portion 111. Further, the insertion portion 112 is securely interposed in the groove portion 111 such that the gap between the inside wall of the groove portion 111 and the insertion portion 112, especially, the gap δ (see FIG. 2) between the second side wall 111*b* and the insertion portion 112, is uniformed. Therefore, the groove portion 111 and the insertion portion 112 are securely brazed. This improves yields of the tubes (brazing). Further, this reduces a manufacturing cost of the radiator 100.

Further, the second side wall 111*b* is formed with the second projections 113*b* that project from the portion between the second side wall 111*b* and the connecting portion 111*c* to a side opposite to the connecting portion 111*c* with respect to the second side wall 111*b*. The ends of the second projections 113*b* are in contact with the inside wall 110*d*. Therefore, when the first side wall 111*a* approaches the insertion portion 112 and presses the insertion portion 112 toward the second side wall 111*b*, that is, when the compression increases from the state shown in FIG. 8B to the state shown in FIG. 8C, the second side wall 111*b* is less likely to move and separate from the insertion portion 112.

Therefore, the gap between the insertion portion 112 and the inside wall of the groove portion 111, especially the second side wall 111*b*, can be uniformed and the insertion portion 112 can be interposed in the groove portion 111.

[Second Embodiment]

In the first embodiment, the projection-forming device 210 is continuously driven with the feeding of the work 10W so that the projections 110*b* are continuously formed. Also, the projections formed at the predetermined portion of the work low are crushed to flatten the predetermined portion. In the second embodiment, only a predetermined of the work 10W other than a portion corresponding to the tank insertion portion 110*a* is pressed to form the projections 110*b* while the work 10W is continuously feed in its longitudinal direction. (First step) Then, the work 10W is shaped into a flat tube. Further, the work 10W (tube 110) is cut into a predetermined length.

(Second Step)

Figure 9:
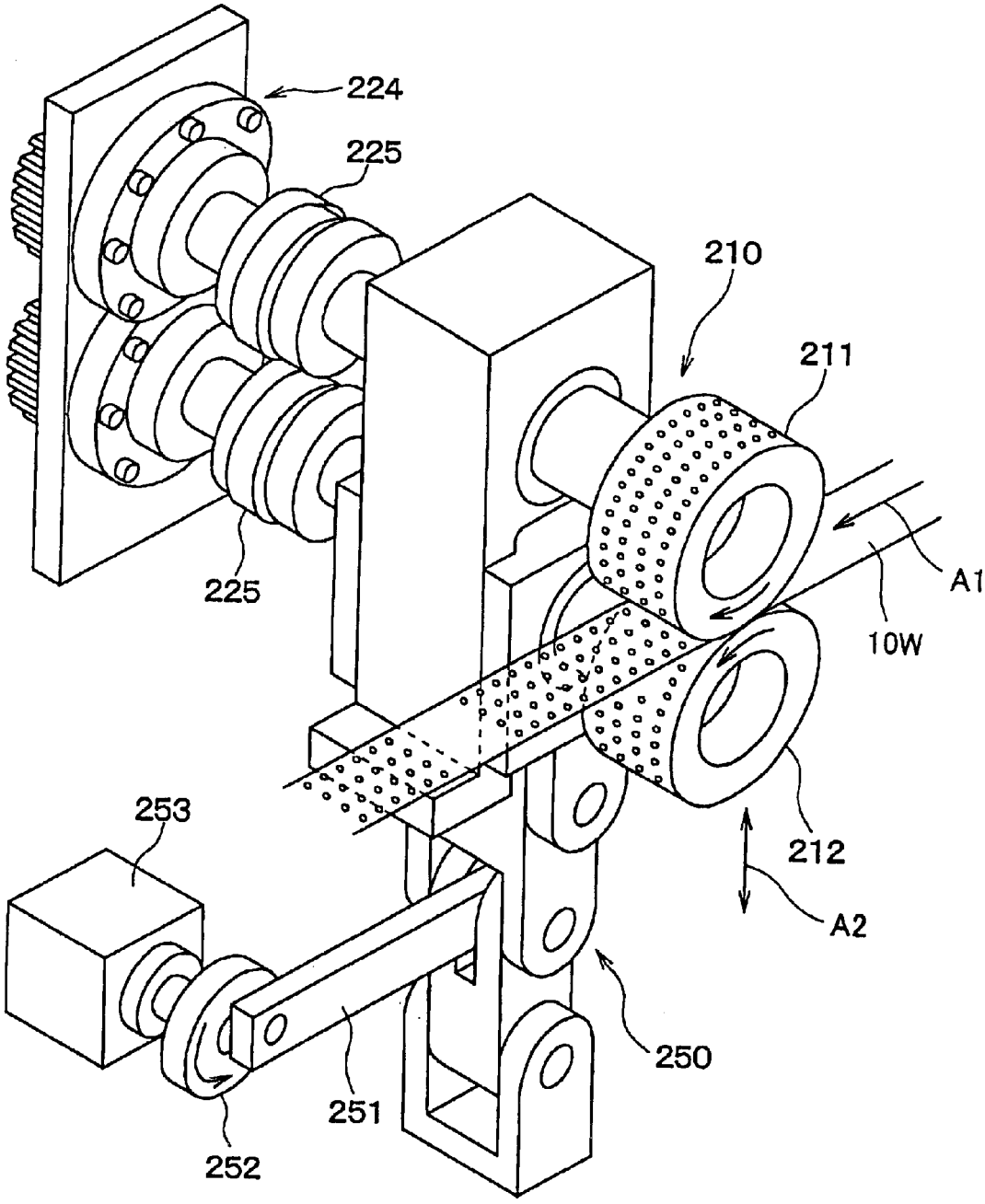
FIG. 9 is a perspective view of an apparatus for manufacturing a tube according to the second embodiment of the present invention.

FIG. 9 is a schematic view of a projection-forming device 210 that is an essential part of the tube-manufacturing device 200 of the embodiment. The projection-forming roller 212 has the projections 212*a* for forming the projections 110*b*. The projection-forming roller 212 moves in a direction (arrow A2) that the thickness of the work 10W is measured. The movement of the projection-forming roller 212 is switched between a time when the projections 110*b* are formed and a time when the projections 110*b* are not formed.

Figure 10A:
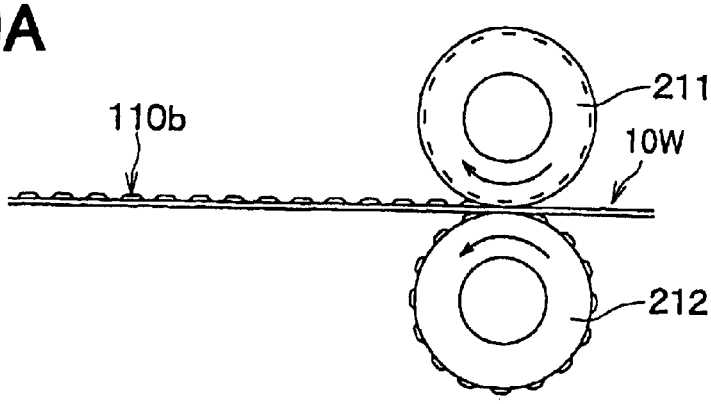
FIGS. 10A to 10D are explanatory views for illustrating operation of the apparatus for manufacturing the tube according to the second embodiment of the present invention.
Figure 10B:
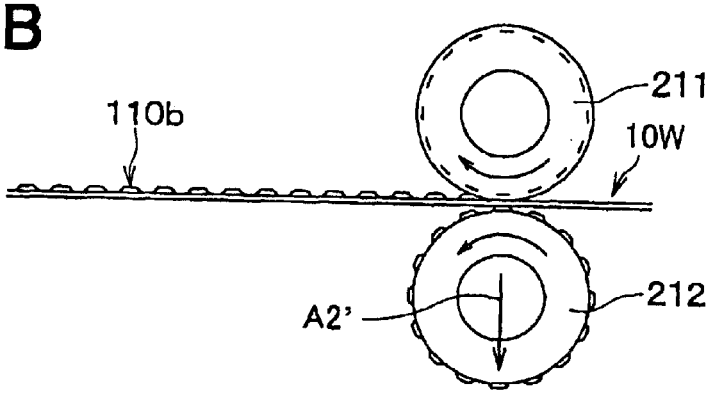
Figure 10C:
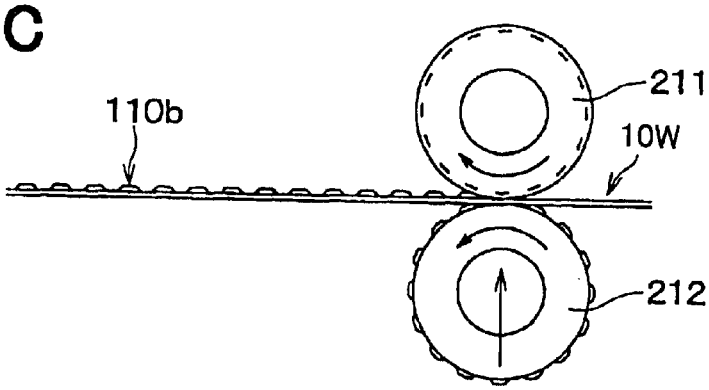
Figure 10D:
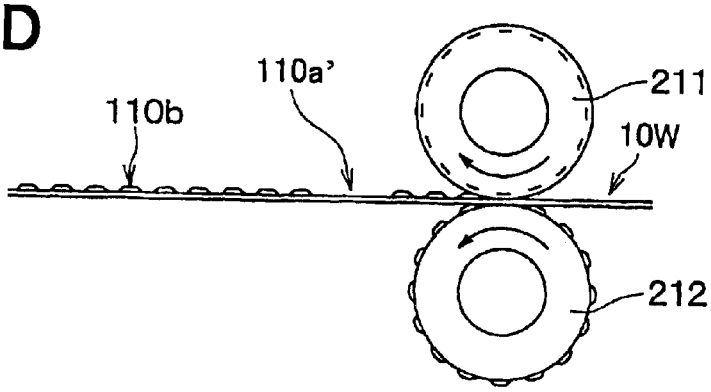

Specifically, when the portion of the work 10W that corresponds to the tank insertion portion 110*a* passes between the projection-forming rollers 211, 212 of the projection-forming device 210, the projection-forming roller 212 moves downwardly (in a direction denoted by an arrow A2') and separates from the work 110W, as shown in FIG. 10B. Thus, the work low maintains the portion 110*a*' corresponding to the tank insertion portion 110*a* flat.

Here, the projection-forming roller 212 is moved by a link mechanism 250 shown in FIG. 9. In FIG. 9, numeral 251 denotes a link lever for driving the link mechanism 250. Numeral 252 denotes an off-centered table (off-centered cam) for sliding the link lever 251. Numeral 253 denotes a servomotor (driving device) for rotating the off-centered table 252. The control unit 240 controls the servomotor 253.

Numeral 224 denotes a driving-gear box for transmitting the rotation of a servomotor (not shown) to the projection-forming roller 211, 212 to rotate the rollers 211, 212. In the embodiment, the projection-forming rollers 211, 212 are linked to the driving-gear box 224 through joints 225 for allowing output shaft to off-center. The joints 225 offsets gaps between output shafts 225 of the driving-gear box 224 and the projection-forming rollers 211, 212 when the projection-forming roller 212 is moved.

Next, effects and advantages of the embodiment will be described.

The projections 110*b* are formed by pressing only the predetermined portion of the longitudinal work 10W, the predetermined portion corresponding to the portion other than the tank insertion portion 110*a*. Therefore, it is not required to exchange the roller 211, 212 when the length of the tubes 110 is changed. As compared with the method of feeding the work 10W intermittently, the productivity of the tubes 110 and the production rate improve.

According to the method and the apparatus for manufacturing the tubes 110 of the embodiment, it is possible to deal with variations of length of the tubes and improve the productivity and the production rate.

Here, only the projection-forming roller 212 is moved. It is also possible to move the projection-forming roller 211 with the projection-forming roller 212. The projection-forming roller 212 is moved downwardly (in the direction of A2') and separated from the work 10W. Therefore, in a case that heights of the projections 110*b* are large, the work 10W may warp toward the projection-forming roller 212 (downwardly) when the projection-forming roller 212 separates from the work 10W. In such a case, a guide 226 can be provided for restricting the work 10W from warping toward the projection-forming roller 212 (downwardly), as shown in FIG. 11A.

Figure 11A:
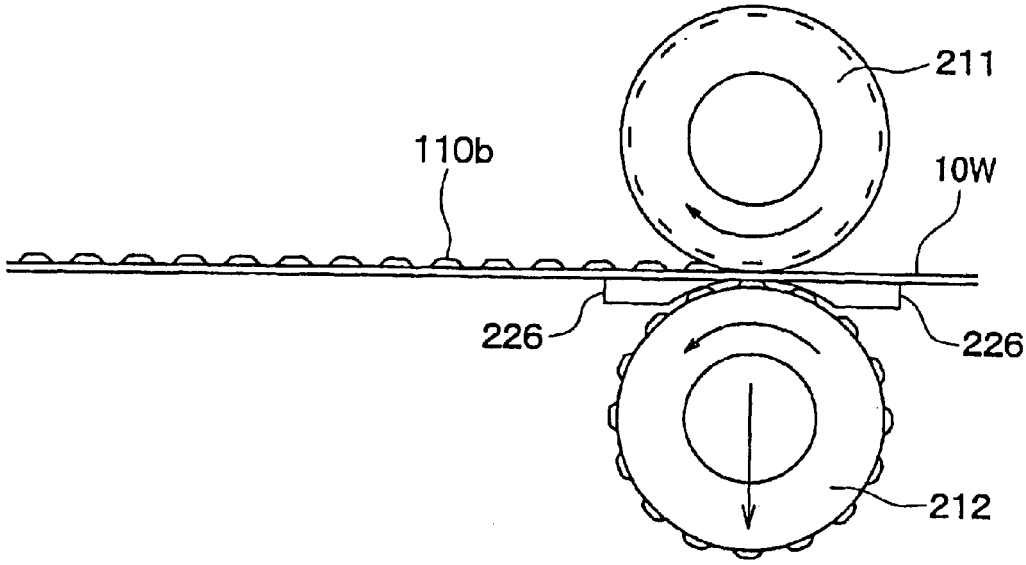
FIGS. 11A and 11B are explanatory views for illustrating modifications of the apparatus for manufacturing the tube according to the second embodiment of the present invention.
Figure 11B:
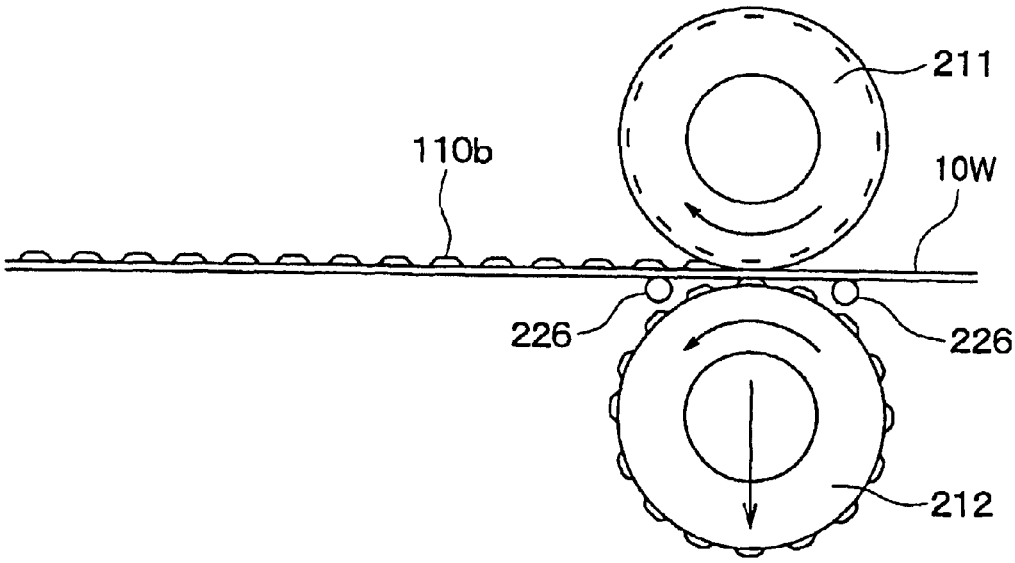

Here, the guide 226, shown in FIG. 11A, is in a form of block that guides the work 10W with a relatively large surface. The guide 226, shown in FIG. 11B, is in a form of cylindrical roller that rotates to guide the work 10W.

[Other Modified Embodiments]

In the first and the second embodiments, the first projections 113*a* and the second projections 113*b* are formed on the first side wall 111*a* and the second side wall 111*b*, respectively. At least the first side wall 111*a* requires the projections. Thus, it is possible to eliminate the second projections 113*b*.

In the first and the second embodiments, the present invention is employed to the tubes 110 of the radiator 100. However, the present invention is not limited to this, but can be employed to tubes (pipes) for other purposes. In addition, the cross-section of the tube 110 is not limited to the shape described in the above embodiments, but can be a simple elliptic shape or circular shape.

The tubes 110 can be joined by methods other than brazing. For example, the tubes 110 can be joined by electric welding, as an electro-resistance-welded tube. Further, in the above embodiments, the projections 110*b* are formed in a step shown in FIG. 6A. The present invention is not limited to this. For example, the projections 110*b* can be formed in a step shown in FIG. 6C.

What is claimed is:

1. A method of manufacturing tubes, each of which has a plurality of projections projecting inwardly from an inside wall of a portion of the tube other than a predetermined portion, the method comprising:

pressing a work, which has a shape of band plate, to form projections on the work while the work is fed in its longitudinal direction;

crushing a projection formed at a predetermined portion of the work to flatten the predetermined portion; and shaping the work into substantially a tubular shape and cutting the work into predetermined lengths to form the tubes.

2. The method according to claim 1, wherein the shaping is performed before the cutting.

3. The method according to claim 1, wherein the projection formed at the predetermined portion is crushed by a pressing-protrusion of a roller.

4. The method according to claim 3, wherein rotation of the roller is controlled by a control unit.

5. The method according to claim 1, wherein the predetermined portion of the work that is flattened in the crushing corresponds to a longitudinal end of a tube.

6. An apparatus for manufacturing tubes, each of which has a plurality of projections projecting inwardly from an inside wall of a portion of the tube other than a predetermined portion, the apparatus comprising:

a first shaping device that presses a work, which has a shape of band plate, to form projections on the work while the work is fed in its longitudinal direction;

a second shaping device that crushes a projection formed at a predetermined portion of the work to flatten the predetermined portion; and a third shaping device that shapes the work into substantially a tubular form and cuts the work into predetermined lengths to form the tubes, the third shaping device being provided forward of the second shaping device in a feed direction of the work.

7. The apparatus according to claim 6, wherein the first shaping device and the second shaping device include roller shaping machines that rotate to shape the work.

8. The apparatus according to claim 7, further comprising:

a control unit that controls rotation speed of the second shaping device in accordance with distances between the predetermined portions where the projections are crushed.

9. The apparatus according to claim 7, wherein the roller shaping machine includes a roller having a protrusion for crushing the projection, wherein rotation of the roller is controlled by a control unit.

10. The apparatus according to claim 6, wherein the predetermined portion flattened by the second shaping device corresponds to a longitudinal end of the tube.

11. A method of manufacturing a tube, comprising:

pressing a work, which has a shape of band plate, to form projections on the work while the work is fed in its longitudinal direction;

crushing at least one projection formed at a portion of the work to flatten the portion; and shaping the work into substantially a tubular shape after the crushing.

12. The method according to claim 11, further comprising cutting the work into lengths to form tubes after the shaping is performed.

13. The method according to claim 12, wherein the crushing is performed using a pressing-protrusion of a roller.

14. The method according to claim 13, further comprising controlling operation of the roller using a control unit.

15. The method according to claim 12, wherein the portion of the work, which is flattened in the crushing, corresponds to a longitudinal end of a cut tube.

16. An apparatus for manufacturing tube, comprising:

a first shaping device that presses a work, which has a shape of band plate, to form projections on the work while the work is fed in its longitudinal direction;

a second shaping device that crushes at least one projection formed at a portion of the work to flatten the portion; and a third shaping device that shapes the work into substantially a tubular form, the third shaping device being provided forward of the second shaping device in a feed direction of the work.

17. The apparatus according to claim 16, the third shaping device cuts the work into lengths to form tubes, after shaping the work into substantially the tubular form.

18. The apparatus according to claim 16, wherein the first shaping device and the second shaping device include roller shaping machines that rotate to shape the work.

19. The apparatus according to claim 18, further comprising: a control unit that controls rotation speed of the second shaping device in accordance with distances between the portions where the projections are crushed.

20. The apparatus according to claim 17, wherein the portion flattened by the second shaping device corresponds to a longitudinal end of a cut tube.

* * * * *